United States Patent [19]

Frisch et al.

[11] Patent Number: 4,890,468

[45] Date of Patent: Jan. 2, 1990

[54] METHOD FOR MEASURING AND CORRECTING THE PLUNGER ADJUSTMENT IN HIGH-SPEED STROKE PRESSES

[75] Inventors: Helmuth Frisch, Schönberg; Johann Hartinger, Grafenau; Alois Weber, Freyung, all of Fed. Rep. of Germany

[73] Assignee: S & S Electronike Geratebau Cmbit., Schonberg, Fed. Rep. of Germany

[21] Appl. No.: 258,164

[22] Filed: Oct. 14, 1988

[30] Foreign Application Priority Data

Nov. 17, 1987 [DE] Fed. Rep. of Germany ..... 3739023

[51] Int. Cl.[4] ..... B21D 55/00

[52] U.S. Cl. ..... 72/21; 83/72; 73/1 J

[58] Field of Search ..... 72/11, 21, 22, 23, 389, 72/26; 83/72, 74; 364/476; 73/1 D, 1 J, DIG. 2

[56] References Cited

U.S. PATENT DOCUMENTS 4,408,471 10/1983 Gossard et al. ..... 72/21
4,802,357 2/1989 Jones ..... 72/21

FOREIGN PATENT DOCUMENTS 0007440 1/1984 Japan ..... 72/21
1082536 3/1984 U.S.S.R. ..... 72/21
1171171 8/1985 U.S.S.R. ..... 72/21
1175632 8/1985 U.S.S.R. ..... 72/21

*Primary Examiner*—David Jones
*Attorney, Agent, or Firm*—Arnold S. Weintraub; William D. Blackman

[57] ABSTRACT

Described is a method for measuring and correcting the plunger adjustment in high-speed stroke presses. The plungers are used for cutting, punching, bending and/or embossing semi-finished goods or the like with high tolerance requirements. The plunger must be readjusted in accordance with the number of strokes per minute and the plunging depth of the plunger is measured. This is carried out using a detector head being provided with a plurality of induction loops, which is guided with the plunger stroke along a permanent magnetic strip, whose longitudinal extension is subdivided into alternating North/South poles. The induced voltage development is scanned through cosine and sine functions of the induction coils for any predetermined travel unit, and the amplitudes of the two functions are measured and evaluated at the turnover point. That means that one of the amplitudes or the maximum neighboring amplitude as measured at the return point serves as reference voltage and other amplitude advances the measured value.

6 Claims, 3 Drawing Sheets

METHOD FOR MEASURING AND CORRECTING THE PLUNGER ADJUSTMENT IN HIGH-SPEED STROKE PRESSES

BACKGROUND OF THE INVENTION

1. Field of the Invention

The invention relates to a method for measuring and correcting the plunger depth adjustment in a high-speed stroke press and circuitry for implementing such method.

2. Description of the Prior Art

It has been known from high-speed presses which perform a machining operation that the plunging depth of the upper tool into an associated lower tool increases with increasing operating speed, thus altering considerably the required tolerances of the press both for cutting or punching processes and for bending or embossing work, and influencing them in a negative sense. But not only the semi-finished products or the like to be produced suffer from the plunger misadjustment, but the tools will be subject to increased wear, thus resulting in unavoidable downtimes and increased tooling expenditures.

A circuitry is disclosed in DE-PS No. 27 31084 by means of which the actual plunging depth of such a plunger is determined by inductive measurement permitting a subsequent comparison between actual and specified values in order to effect the required correction. There, the plunger adjustment is corrected by means of a motor at stroke numbers exceeding 600 strokes per minute, the motor acting upon a stroke bearing setting member through a gear train with high speed reduction by means of which the plunger is adjustable with respect to its driving mechanism, thus modifying the plunging depth, i.e., it may be corrected as required. Instead of the current actual-value measurement of the plunging depth, in this known circuitry a correction may be made by means of a program stored in a memory, setting signals being fed to one-shot multivibrators in accordance with the program depending on the number of strokes, which in turn activate the correction motor in accordance with the signal information units.

Another known circuitry for a setting drive of a plunger adjustment (DE-PS 28 33 929) uses at least one limit switch, placed settable in the operative path of the plunger on the press frame for reading the plunging depth, and the signal output of which is connected to the set input of a first flip-flop, the signal output of which is back-fed to the reset input of another flip-flop through of a branch line via a switch step determining the amount of an adjustment step; a set input of still another flip-flop being connected to a switch which is activated on interruption of the operation of the cutting press, and a reset input of the latter flip-flop being connected to another switch which is activated whenever the plunger reaches its lowermost position with respect to its drive mechanism, which it must not fall short of, depending on the tool.

The two known circuitry arrangements have the advantage that the plunger adjustment is possible during the operation of the press, but on the other hand, they have the substantial disadvantage that the circuitry arrangements are very expensive requiring a correspondingly high expenditure both for the hardware and for the software.

SUMMARY OF THE INVENTION

The present invention, subject matter of this application, is based upon this known prior art and it improves the accuracy and reliability of the system. The measurements of the plunger depths and the corrections carried out therewith will now become feasible with as low a susceptibility to trouble as possible and with a reasonably low expenditure as to apparatus.

The inventive solution of this problem is obtained by the features stated in claim 1.

Further advantageous improvements and developments, in particular also for the construction of the circuit for implementing the method, result from the subclaims.

The present inventive solution of the problem will permit, in an advantageous manner, more precise adjustment of working tools of the type under discussion to higher quality requirements, and that even in the case of an increased number of strokes per minute of the associated presses. Special parts of the electric and electronic industry may thus be produced with very close tolerances independently of stroke speeds, e.g., for stroke speeds which may attain even 2000 strokes per minute. The measuring system of the present invention is sturdy enough to withstand the rough environmental conditions characteristic of such press operations without its high measuring precision being impaired. The implementation of the method with its associated circuitry arrangement is simple, and particularly for the operator of the press, limitations of the tool setting space are practically absent, as opposed to prior art. Neither is it necessary in the present inventive solution of the problem to make subsequent adjustments or special mechanical adaptations on the press itself which would require much time if necessary.

A magnetic tape, magnetized at spots certain predetermined highly precise distances apart, is put upon a metal strip and serves as a measuring ruler, and a sensor head is characterized by four coils to which a carrier frequency is fed. Voltage is induced in the four coils of the sensor head by relative movement between the metal strip and the sensor, and is fed to a function evaluation device. Due to the fact that the coil arrangement furnishes two sine voltages displaced by ninety degrees, it is very simple to obtain recognition of the direction of the relative movement between the metal strip and the sensor head, and therewith also between the plunger movement and the press frame. Especially simple is the evaluation of the inductive and non-contact measuring method by effecting at first a rough travel measurement by generating counting pulses at the zero passages of the sine/cosine functions, and effecting the storage of the amplitude quantity at the turning points for the two functions and evaluating same for the precise measurement.

The relative movement between the sensor head and the permanent magnetic head may serve equally well for the adjustment of the press as for the calculation of its automatic operation. The actual deviation, if any, is measured and displayed at first, and the machine is stopped following the measurement. If a correction is required due to the measurement, it is automatically carried out.

BRIEF DESCRIPTION OF THE DRAWINGS

Taking reference to the attached drawings, the inventive procedure will be described in more detail, comprising also an advantageous circuit arrangement for implementing the procedure.

Such drawings represent.

DESCRIPTION OF THE PREFERRED EMBODIMENT

Figure 1:
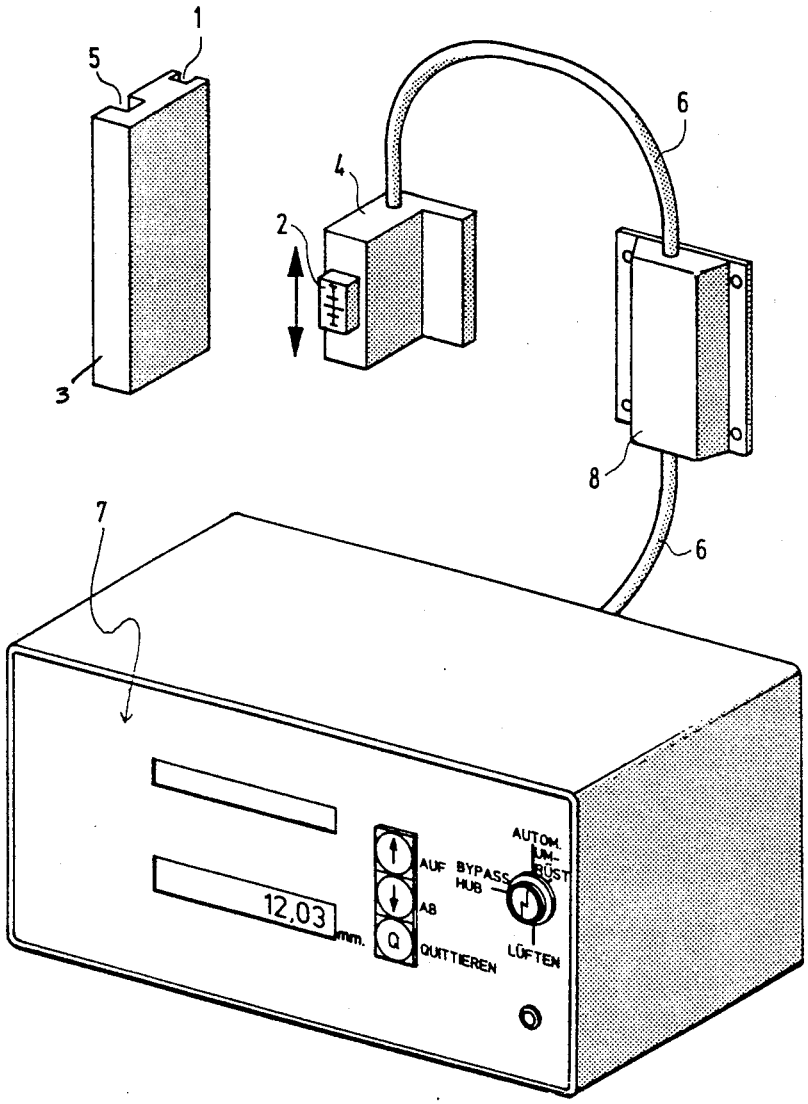
FIG. 1 is individual parts of the device in perspective representation for implementing the procedure.

An advantageous embodiment of the invention showing a device for the implementation of the procedure for measuring and correcting the plunger adjustment in high-speed stroke presses is shown in perspective representation in FIG. 1, including the individual parts needed therefor. Block 3 accommodates the magnetic ruler 1 which is characterized by alternating magnetic poles being disposed in highly precise distances from one another amounting to two millimeters each (cf. also FIG. 3), said magnetic poles being applied to a suitable metallic strip. Block 3 is firmly mounted upon the machine frame of the press, an accommodating groove being provided there for this purpose. It is also possible to attach said block 3 not to the static press part but to the moved tool part.

The sensor head 4 consists substantially of a detector 2 in which four coils are accommodated to which a suitable carrier frequency is fed. The relative movement between the static tool half of the press and the movable tool half, i.e., the plunger, corresponds to the relative movement between the said magnetic ruler 1 and the sensor head 4, the detector 2 being moved in close proximity to the magnetic ruler and parallel to same in the represented direction of the double arrow. The thus possible non-contact length measurement of the covered travel along the North/South pole arrangement alternating every 2 mm with distance of 0.1 to 0.5 mm max. between magnetic ruler 1 and detector 2 acts upon the carrier frequency and induces alternating voltages upon the carrier frequency in the coils of the detector head 4. The form of these voltages corresponds to sine functions which are however displaced by 90° with respect to one another in accordance with the distances of the alternating North/South pole arrangement in the ruler, since the distances of the various coils between one another in the detector 2 are harmonized with the distances of the alternating North/South pole arrangement in the ruler. The voltages scanned via the detector 2 in the scanning head 4 are fed to the processing and display unit 7 and are processed there in a manner to be described later.

A coupling 8 facilitates the separation of the sensor head fastened on the plunger and movable with it in the preferred embodiment from the processing and display unit 7, and the thus independent installation of the unit 7 on a suitable location with the press or even outside of it.

The front panel of the unit 7 comprises a text display for the operator, a figure display showing the obtained measuring quantities, operation keys for various functions, and a key selector switch for the possible modes of operation. Such possible modes of operation include the adjustment of the press, in which parts of the unit are set to a certain stroke and therewith to a defined plunger position, which is approximately identical with the respective tool exchange. Another mode of operation encompassed by the concept of "automatic" is that the unit after adjustment will adapt itself automatically to the new plunger position, it being possible that the unit reads a certain deviation, stops the press if such deviation exceeds or falls short of a certain tolerance limit, and then carries out the required correction automatically. In another mode of operation "Bypass/-Stroke" the unit outputs are deactivated; in this mode each actual stroke is displayed, such mode of operation lying outside of the operation proper of the unit.

Finally there is provided one mode of operation with the denomination "Ventilation" which is used to move the plunger upward by a path distance which is determined at the start-up operation, i.e., to separate the two tooling halves for examination purposes.

The non-contact sliding movement of the scanning head 4 along the magnetic ruler 1 conducts, to begin with, a rough measurement of the travel by the generation of counting pulses at the zero passages of the sine curve because there is generated one pulse at every 2 mm of travel. The amplitude values are recorded at the turnover points of the voltage and stored, and the thus advanced counting pulses are used for a rough measurement of the travel of a predetermined stroke quantity. The analogous sine amplitude as measured in the turnover point of the plunger movement (cf. also FIG. 2) furnishes the exact value via the known inverse-sine function linkage, or it is possible, as will be described later in more detail, to calculate same, in this connection being necessary to mention, that also the recognition of the plunger direction is possible due to the displaced coil arrangement in the detector head and the therewith given displacement of the voltages by 90 degrees.

The plunging depth of the plunger is by principle continuously or variably settablee, the plunger deviation in each case being measured on increasing stroke frequency and the increasing plunging depth by means of said increasing frequency during the run of the press, same being stopped if a predetermined preset tolerance limit is either exceeded upward or fallen short of downward. The correction of the appearing deviation is carried out during the stoppage of the press, after switching over same from the operation mode "Continuous Run" to "Setting", meaning a discontinuing run. After to the required correction, the press continues working normally, until the preset tolerance range is stepped out again or until the press is required to be readjusted.

Figure 2:
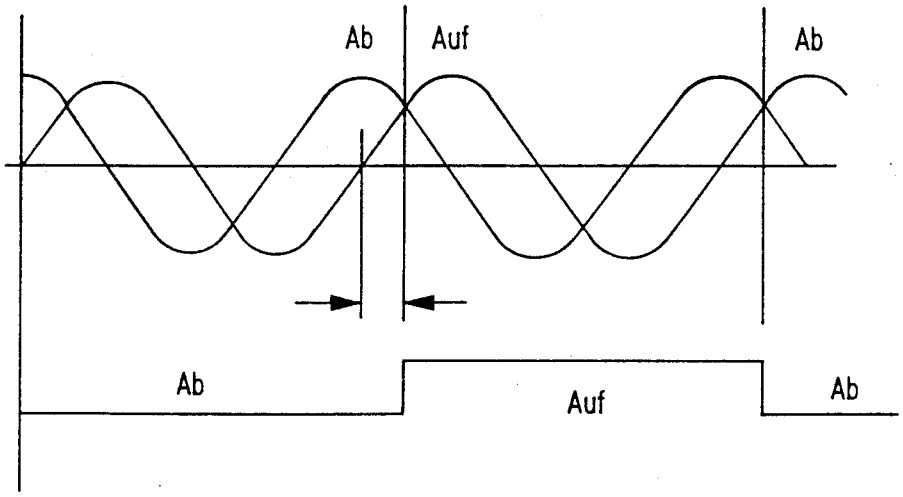
FIG. 2 is a functional representation of the amplitudes as measured at the turning point of the plunger for elucidation of the inventive procedure.

The application of the scanning head 4 in connection with the magnetic ruler 1 in FIG. 1 (leaving out the press proper), is very advantageous because the thus predeterminable corrections are both independent from the tooling proper, i.e., the plunger etc., and the static press half. Wear of the individual tool parts do not impair the measuring procedure, as is the case, e.g., in the plunger correction by means of the known accumulated-value switches. The sine/cosine curve in the coils in the embodiment dispatched by 1 mm each within the sensor head 4, is represented in FIG. 2 at the return point of the up/down movement of a plunger. It is, in the long run, not interesting for the measurement of the return point, how may sine or cosine periods have been passed up to the return point of the plunger; interesting for measuring the return point is only the last maximum of the sine or cosine function prior to the return pint, or the amplitude of the functions immediately at the point of return. One of these values is used as reference voltage for the evaluation, and each last voltage value appearing at the return point as measuring value. As recognizable from FIG. 2, the return point is practically a reflection plane for both the sine and the cosine functions which defines the measuring value and the reference value to be fed to the evaluation electronic unit and permits, in the preferred embodiment of the invention, a maximum deviation from the specified plunging depth of up to 1/100th millimeter.

Figure 3:
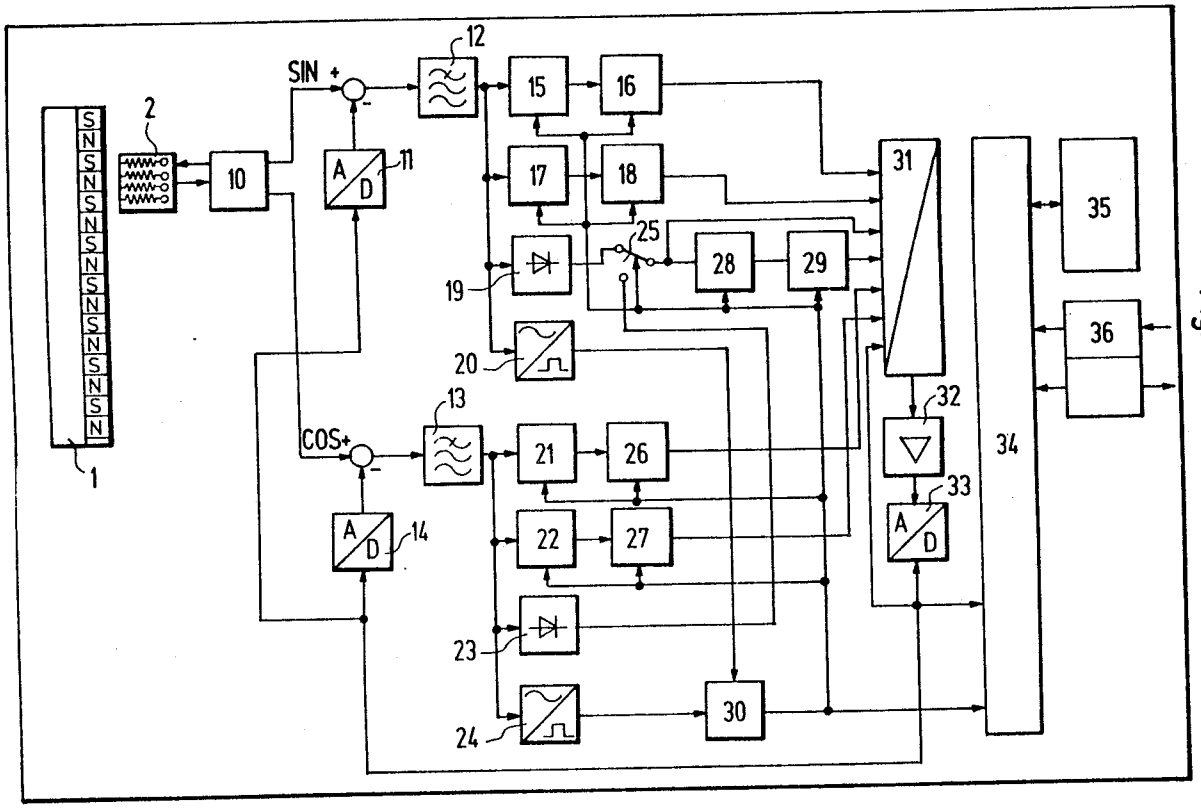
FIG. 3 is a typical circuit arrangement for implementing this procedure.

FIG. 3 shows a block schematic of a circuit which permits realization of the above functions. According to this diagram, the scanning head 4 is guided along the magnetic ruler at a certain distance over the detector 2 consisting of four coils to which are fed, by a suitable carrier frequency via an oscillator 10, the signals induced due to the relative movement between detector 2 and magnetic ruler 1 in the form of the said sine or cosine signals each directly to an associated low-pass filter 12, 13, or, via the digital-analog converters 11, 14 to the other low-pass filter 13, 12 each. Each low-pass filter 12, 13 output is connected with the two peak value memories 15, 17 or 21, 22, a rectifier 19 or 43, and a transducer 20, 24 as shown in the representation of the various functions.

An electronic relay 25 converts the analogous output signal information units of the assemblies 19 or 23 into digital commands and feeds such digital signals alternatively to a peak value memory 28 to which an analogous measuring value memory 29 is connected downstream, in accordance with the analogous measuring value memories 16, 18, 26 and 27 which are connected to the outputs of the peak value memories 15, 17, 21 and 22. Therefore, for an evaluation of the signals retrieved by the amplitude values of the coils of detector 2, the demodulated associated direct-current portions superimposed to the alternate current portions may be used as travel information by measuring the positive and negative peak values and the digitalization of such measuring values may be used for a computer-controlled correction. In this respect, the integrated circuit logic 30 which is connected with the transducers 20 or 24, is activated by them so that at first the storage pulses for the analog measuring value memories 16, 18, 26 and 27 or 29, and subsequently the reset pulses for the peak value memories 15, 17, 21, 22 or 28 are advanced or generated in synchrony with the zero passages of the sine and cosine signals. The outputs of the analog measuring value memories 16, 18, 27 and 29 are connected which is amplified by means of an impedance transformer 32 and may be re-fed via the analog-digital converter 33 to the storage logic 34. By means of the multiplexer 31 reversible by the computer, the outputs of which feed an analog/digital converter, as described above, the computer logic has thereby an access to every individual peak value which is fed via the individual peak value memories. Half of the peak-to-peak value is equivalent to the DC voltage offset, which is fed to the respective digital/analog converter in accordance with the correct sign, and is subtracted at the signal input. After correction, the output digital-analog converter signal (14,11) runs through the low-pass filter 13, 12 in order to suppress the demodulated carrier frequency portions (sine/cosine). The rectified signals are fed from the rectifiers in a manner as described above from the output to the reversing switch 25 which is controlled by the logic circuit 30 and lets pass the signal clearly marked with the last maximum at the turnover point, i.e., to the peak value memory connected downstream, simultaneously the voltage maximum being stored in the associated measuring value memory via the logic circuit 30 as a consequence of the conversion of the direction due to the reversal of direction.

By standardization of the turnover voltage to an associated peak value and the subsequent evaluation by the inverse sine function, an interpolation of the travel path is carried out in the preferred embodiment within one millimeter to be exact to a hundredth of a millimeter.

The measurement of the values complemented each to one millimeter is conducted by the computer 34 by counting the zero passages of the sine and cosine signals. The zero passages are processed in memory 34 using the logic circuit. In accordance with the functional diagram, the logic memory 34 is furthermore connected with its display and operation part 35 and to the inputs and outputs 36.

We claim:

1. In a method for measuring and correcting the plunger adjustment of of a high-speed stroke press, the press including a lower tool and an upper plunger movable with respect to the lower tool for performing a machining operation on semi-finished material with high tolerance requirements, in which the plunger must be readjusted depending on the number of strokes per unit of time, and the actual value of the plunging depth of the plunger is measured and compared with a specified plunging depth; the improvement which comprises (a) guiding a sensor head provided with a plurality of induction loops with the plunger stroke along a permanent-magnetic ruler, said ruler being subdivided into a plurality of alternating North/South poles along its longitudinal axis;

(b) scanning the induced voltage for each predetermined path length unit by means of cosine and sine functions of said induction loops, and (c) measuring and evaluating the amplitudes of the two functions at a turning point of the plunger from one direction to another, so that one of the amplitudes or the maximum neighboring amplitude measured at the turning point serves as reference voltage and the other amplitude advances the measured value.

2. The improvement of claim 1, characterized in that, the sensor head or the permanent-magnetic ruler is movable with respect to the lower tool.

3. The improvement of claim 1, are characterized in that the sensor head is moved at close distance to the magnetic ruler and parallel thereto.

4. The improvement of claim 1, characterized in that the plunging depth of the plunger is measured continuously during the run of the stroke press, and that a plunger correction is carried out during stoppage of the plunger following the exceeding or falling short of a preset tolerance limit.

5. The method of claim 1, further comprising the step of advancing counting pulse for a rough travel measurement at the zero passage of every one of the sine functions fed to the induction loops.

6. A circuit for implementing the method claim 1 further comprising the step of subjecting the amplitude values measured at the turning point of the plunger to an inverse-sine function linkage.

* * * * *